US007551158B2

(12) United States Patent
Nishimura et al.

(10) Patent No.: US 7,551,158 B2
(45) Date of Patent: Jun. 23, 2009

(54) DISPLAY DEVICE AND METHOD FOR PROVIDING OPTICAL FEEDBACK

(75) Inventors: Ken A. Nishimura, Fremont, CA (US); Kean Loo Keh, Jalan Yeap Cher Ee (MY); Chin Hin Oon, Penang (MY)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 764 days.

(21) Appl. No.: 11/302,558

(22) Filed: Dec. 13, 2005

(65) Prior Publication Data

US 2007/0132706 A1 Jun. 14, 2007

(51) Int. Cl.
*G09G 3/36* (2006.01)

(52) U.S. Cl. ..... 345/102; 345/87; 345/88; 345/82; 345/55

(58) Field of Classification Search ..... 345/87, 345/102, 88, 84, 55
See application file for complete search history.

(56) References Cited

U.S. PATENT DOCUMENTS

| | | | | |
|---|---|---|---|---|
| 7,242,384 | B2 * | 7/2007 | Yamamoto et al. | 345/102 |
| 7,364,336 | B2 * | 4/2008 | Mori et al. | 362/560 |
| 2003/0011832 | A1 * | 1/2003 | Chang | 358/518 |

* cited by examiner

*Primary Examiner*—Richard Hjerpe
*Assistant Examiner*—Leonid Shapiro

(57) ABSTRACT

A display device for providing optical feedback includes light sources, each for emitting light in a different respective wavelength range, electro-optical elements defining pixels of an image, each for selectively passing light in one of the wavelength ranges and a sensor for measuring the intensity of light output from a portion of the electro-optical elements. To provide the optical feedback, a controller activates one of the light sources, alters those electro-optical elements within the portion of the electro-optical elements that are arranged to pass light in the wavelength range of a select one of the light source and reads out the measured intensity from the sensor. Based on the measured light intensity, the controller adjusts an illumination parameter associated with the select light source.

20 Claims, 4 Drawing Sheets

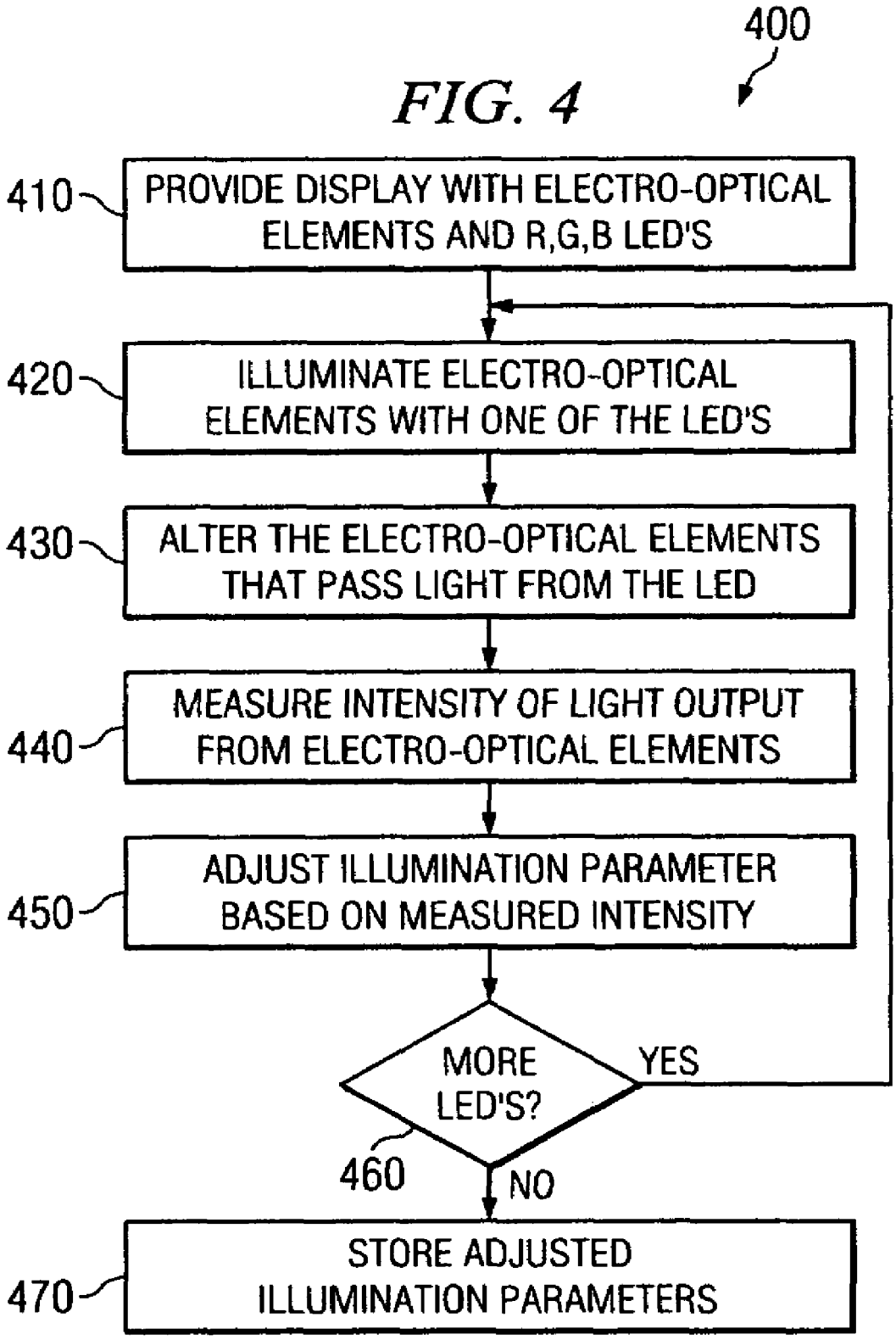
400
FIG. 4
410
PROVIDE DISPLAY WITH ELECTRO-OPTICAL ELEMENTS AND R,G,B LED'S
420
ILLUMINATE ELECTRO-OPTICAL ELEMENTS WITH ONE OF THE LED'S
430
ALTER THE ELECTRO-OPTICAL ELEMENTS THAT PASS LIGHT FROM THE LED
440
MEASURE INTENSITY OF LIGHT OUTPUT FROM ELECTRO-OPTICAL ELEMENTS
450
ADJUST ILLUMINATION PARAMETER BASED ON MEASURED INTENSITY
MORE LED'S?
YES
NO
460
470
STORE ADJUSTED ILLUMINATION PARAMETERS

DISPLAY DEVICE AND METHOD FOR PROVIDING OPTICAL FEEDBACK

BACKGROUND OF THE INVENTION

In liquid crystal display (LCD) devices, such as those used in laptop computers and flat panel televisions, an image is formed by manipulating liquid crystal material disposed between a substrate and a glass cover at discrete points on the display to selectively pass light through the liquid crystal material. At each discrete point, an individually-controllable electro-optical element that defines a pixel of the image is created by forming a common electrode on the substrate and patterning a pixel electrode on the glass cover. The liquid crystal material reacts in response to the electric field established between the common electrode and pixel electrode to control the electro-optical response of the pixel.

For example, the pixel electrodes in LCD devices are typically driven by a matrix of thin film transistors (TFTs). Each TFT individually addresses a respective pixel electrode to load data representing a pixel of an image into the pixel electrode. The loaded data produces a corresponding voltage on the pixel electrode. Depending on the voltages applied between the pixel electrode and the common electrode, the liquid crystal material reacts at that electro-optical element to either block or transmit the incoming light. In some applications, the pixel electrodes can be driven with voltages that create a partial reaction of the liquid crystal material so that the electro-optical element is in a non-binary state (i.e., not fully ON or OFF) to produce a "gray scale" transmission of the incoming light.

A traditional illumination device that is used in color LCD devices is a backlight unit that provides a uniform field of light to each of the electro-optical elements in the display. The backlight unit may be illuminated by red, blue and green light emitting diodes (LEDs) that are mixed to produce white light. However, the light intensity of LEDs degrades differently over time. Therefore, some LCD devices include an optical feedback system that measures the degradation of each LED and compensates for the LED degradation by adjusting the intensity of each LED, for example, by pulse width modulation of the LED drive current. Typically, an optical sensor fitted with a color filter is positioned adjacent the backlight unit to measure the intensity of light produced by each LED.

However, the color sensors available on the market today are typically complicated and expensive. In addition, measuring the light in the backlight unit does not take into account any changes in the spectral content resulting from the light passing through the liquid crystal material. Therefore, what is needed is a display device including a low cost, simple optical feedback system that compensates for degradation of the light due to the LCD.

SUMMARY OF THE INVENTION

Embodiments of the present invention provide a display device for providing optical feedback. The display device includes light sources, each for emitting light in a different respective wavelength range, electro-optical elements defining pixels of an image, each for selectively passing light in one of the wavelength ranges and a sensor for measuring the intensity of light output from a portion of the electro-optical elements. To provide optical feedback, the display device further includes a controller for activating at least one of the light sources, altering those electro-optical elements within the portion of the electro-optical elements that are arranged to pass light in the wavelength range of a select one of the light sources and reading out the measured intensity from the sensor. Based on the measured light intensity, the controller adjusts an illumination parameter associated with the select light source.

In one embodiment, the controller includes an illumination drive circuit operable to individually drive each of the light sources, a pixel controller operable to individually drive each of the electro-optical elements and a display controller operable to control the illumination drive circuit to activate one of the light sources and to adjust the illumination parameter. The display controller is further operable to control the pixel controller to alter the electro-optical elements. In addition, the display controller is operable to control the sensor to read out the measured intensity of light output from the electro-optical elements.

In an exemplary embodiment, the display controller is further operable to compare the measured intensity to a known intensity associated with the select light source, estimate a degradation value associated with the select light source based on the comparison between the measured intensity and the known intensity and adjust a duty factor of the pulse width modulation of the select light source to compensate for the degradation value.

Embodiments of the present invention further provide a method for providing optical feedback in a display. The method includes providing electro-optical elements defining pixels of an image, in which each of the electro-optical elements selectively passes light in one of a plurality of different wavelength ranges. The method further includes illuminating the electro-optical elements with light in at least a select one of the wavelength ranges, altering select ones of the electro-optical elements to pass the light in the select one of said wavelength ranges and measuring a measured intensity of light output from the select ones of the electro-optical elements. Based on the measured intensity, the method further includes adjusting an illumination parameter associated with the select one of said wavelength ranges.

BRIEF DESCRIPTION OF THE DRAWINGS

The disclosed invention will be described with reference to the accompanying drawings, which show sample embodiments of the invention and which are incorporated in the specification hereof by reference, wherein:

FIG. 4 is a flow chart illustrating an exemplary process for providing optical feedback in displays, in accordance with embodiments of the present invention.

DETAILED DESCRIPTION OF EXEMPLARY EMBODIMENTS

Figure 1:
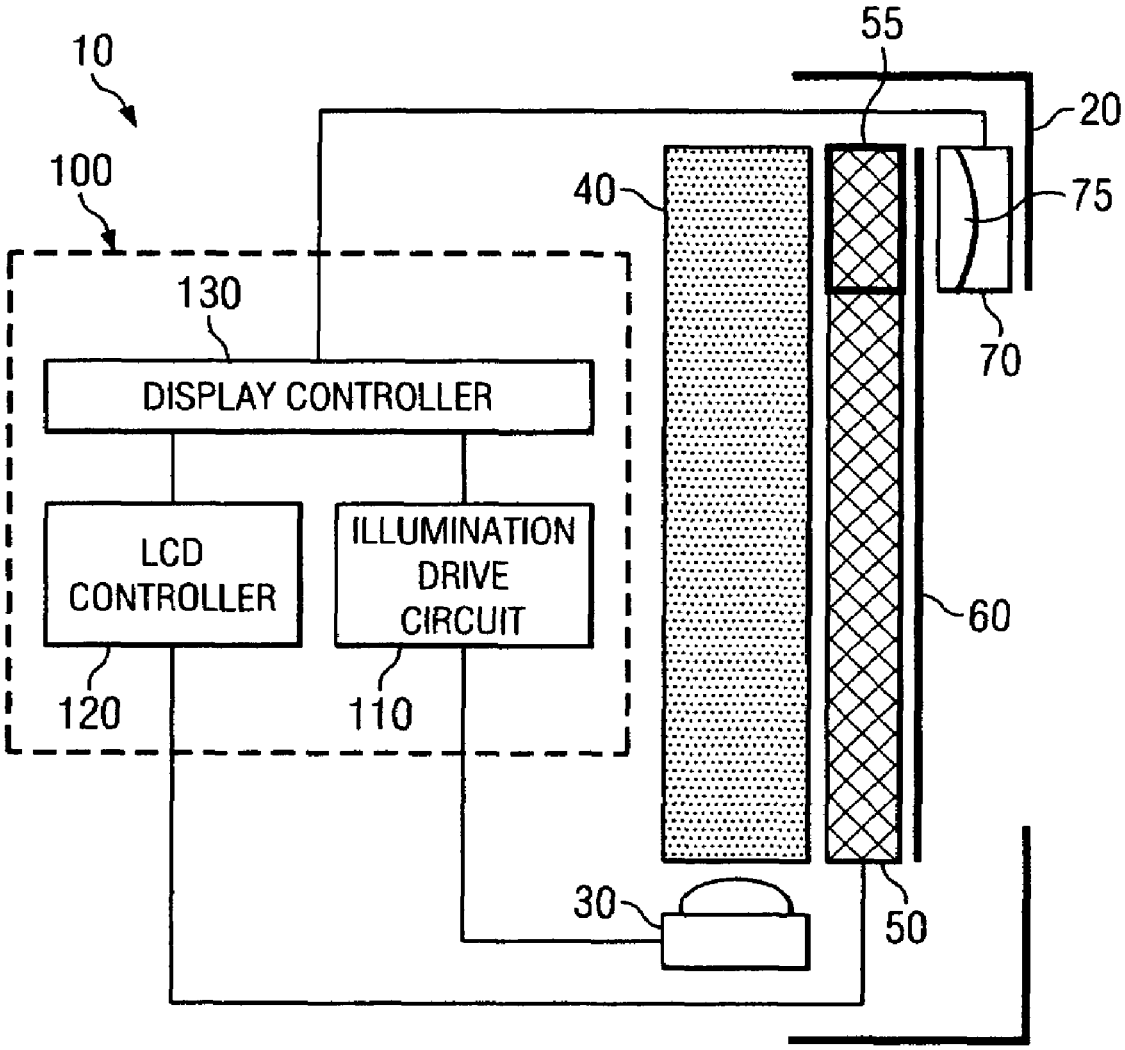
FIG. 1 is a cross-sectional view of an exemplary display device capable of providing optical feedback, in accordance with embodiments of the present invention.

FIG. 1 is a cross-sectional view of an exemplary display device 10 capable of providing optical feedback, in accordance with embodiments of the present invention. The display device 10 shown in FIG. 1 includes a liquid crystal device 50 and an illumination device 30. The illumination device 30 illuminates a backlight unit 40 that provides a uniform field of light to the liquid crystal device 50. For example, in one embodiment, the illumination device 30 includes red, blue and green light emitting diodes (LEDs) whose outputs are mixed to produce a white light source that illuminates the backlight unit 40. In other embodiments, the illumination device 30 includes a white LED in combination with red, green and blue LEDs.

The liquid crystal device 50 includes a two-dimensional array of electro-optical elements (not specifically shown) defining pixels of an image displayed on the display device 10. Adjacent the liquid crystal device 50 is a color filter array (CFA) 60 formed of a number of color filters, each designed to absorb light within a particular wavelength range in order to pass light in other wavelength ranges. The color filters are spatially arranged in the CFA 60 to provide a one-to-one optical coupling between color filters and electro-optical elements within the liquid crystal device 50. For example, in one embodiment, the CFA 60 includes a checkerboard pattern of red filters, green and blue color filters, each optically coupled to one of the electro-optical elements. The CFA 60 can be included within the liquid crystal device 50, disposed between the backlight unit 40 and the liquid crystal device 50 or laid over the liquid crystal device 50 on the opposite side from the backlight unit 40, the latter being illustrated in FIG. 1.

The illumination device 30, backlight unit 40, liquid crystal device 50 and CFA 60 are mounted in a display casing 20, such that a portion 55 of the liquid crystal device 50 is covered by the display casing 20. Between the CFA 60 and the edge of the display casing 20 covering the portion 55 of the liquid crystal device 50 is located an optical sensor 70 having an active area 75 spatially arranged to provide optical coupling between the portion 55 of the liquid crystal device 50 and the optical sensor 70. The active area 75 of the optical sensor 70 is operable to measure the intensity of light output from the portion 55 of the liquid crystal device 50 and to produce measurement data representing the measured intensity.

Although the optical sensor 70 is shown within the display casing 20 in FIG. 1, in other embodiments, the optical sensor 70 can be positioned outside of the display casing 20 to view a portion 55 of the liquid crystal device 50 within a viewable area on the screen. For example, in one embodiment, the optical sensor 70 is provided within a camera that includes a lens and/or tube. The camera is mounted on the outside of the display casing 20 such that the optical sensor 70 is positioned at an angle from the viewable screen to measure the intensity of light output from a portion 55 of the viewable area. To minimize any reduction in image quality resulting from the measurement process, the measurements can be taken in only select image frames. For example, in an exemplary embodiment, the measurements are taken in one or two frames out of each group of fifty or sixty frames.

The display device 10 further includes a controller 100 operable to control the display device 10 and provide optical feedback in the display device 10. More specifically, the controller 100 includes an illumination drive circuit 110 for controlling the illumination device 30, an LCD controller 120 for controlling the liquid crystal device 50 and a display controller 130 for controlling the illumination drive circuit 110 and LCD controller 120 in response to measurement data output from the sensor 70. As used herein, the term "controller" includes any hardware, software, firmware, or combination thereof. As an example, the controller 100 could include one or more processors that execute instructions and one or more memories that store instructions and data used by the processors. As another example, the controller 100 could include one or more processing devices, such as microcontrollers, Field Programmable Gate Arrays (FPGAs), or Application Specific Integrated Circuits (ASICs), or a combination thereof In accordance with one embodiment of the present invention, the illumination drive circuit 110 is capable of individually activating ("turning on") each of the LEDs within the illumination device 30 to enable the optical sensor 70 to measure the intensity of light output from the liquid crystal device 50 in response to illumination by one of the LEDs. In addition, the LCD controller 120 is capable of altering the electro-optical elements within the portion 55 of the liquid crystal device 50 to allow light emitted from one of the LEDs to pass through the liquid crystal device 50 and into the optical sensor 70. In embodiments in which a white LED is used in combination with red, blue and green LEDs, the white LED can be driven separately to measure the intensity of white light or in series with one or more of the red, blue and/or green LEDs to measure the intensity of the combination of white light with red, blue and/or green light.

In accordance with another embodiment of the present invention, with each electro-optical element being optically coupled to only one color filter within the CFA 60, the LCD controller 120 is capable of altering only those electro-optical elements within the portion 55 that are optically coupled to a color filter corresponding to a particular LED wavelength. For example, since red color filters only pass red light (and not blue or green light), the LCD controller 120 can be operable to alter only those electro-optical elements within the portion 55 that are optically coupled to red color filters. In this embodiment, the illumination drive circuit 110 can either simultaneously activate multiple ones of the LEDs within the illumination device 30 while measuring red, blue or green light by altering only those electro-optical elements that pass red, blue or green light, respectively, or sequentially activate the red, blue and green LEDs within the illumination device 30 to sequentially measure red, blue or green light, respectively.

The light passing through each electro-optical element and associated color filter impinges on the active area 75 of the optical sensor 70, where the intensity of the light is measured. For example, in one embodiment, the active area 75 of the optical sensor 70 is a single measurement sensor capable of measuring the intensity of light output from the electro-optical elements within the portion 55. In this embodiment, a color filter array 60 may not be necessary if the LEDs within the illumination device 30 are sequentially activated. In another embodiment, the active area 75 of the optical sensor 70 includes a respective measurement sensor for each color filter and associated electro-optical element within the portion 55. In other embodiments, the active area 75 of the optical sensor 70 includes a respective measurement sensor for a predetermined number of color filters and associated electro-optical elements within the portion 55. Each measurement sensor measures the intensity of light received at that measurement sensor and produces measurement data representing that measured intensity. Thus, each measurement sensor measures the actual light as measured on the observer side of the display, which takes into account degradation of the LED, as well as changes in the spectral transmissivity of the liquid crystal material and color filters.

The measurement data produced by the measurement sensor(s) in the optical sensor 70 is read out by the display controller 130 to provide optical feedback indicating the light intensity degradation of a particular LED in the illumination device 30. Based on the measurement data, the display controller 130 adjusts one or more illumination parameters associated with that particular LED, and provides the parameter adjustments to the illumination drive circuit 110 for storage and later use. For example, in one embodiment, the display controller 130 is operable to compare the measured intensity, as determined from the measurement data, to a known or initial intensity of an LED and estimate a degradation value (e.g., the percentage of combined LED and LCD degradation over time) for the LED based on the comparison between the measured intensity and the known intensity. The display controller 130 uses the estimated degradation value to adjust the duty factor of the pulse width modulation of the LED or the magnitude of the drive current to compensate for the perceived degradation of that LED.

In another embodiment, the display controller 130 is further operable to measure the light transmitted by the electro-optical elements as a function of the drive voltage applied to the electro-optical elements. For example, the display controller 130 can instruct the LCD controller 120 to drive the electro-optical elements within the portion 55 of the liquid crystal device 50 with voltages that create a partial reaction of the liquid crystal material so that one or more of the electro-optical elements are in a non-binary state (i.e., not fully ON or OFF) to produce a "gray scale" transmission of light emitted from one of the LEDs into the optical sensor 70. From the measurement data provided by the optical sensor 70, the display controller 130 is able to determine the transmission of each color independently as a function of the signal applied to the liquid crystal material. As such, the display controller 130 can compensate for subtle changes in the response of the liquid crystal material to "partial" or "gray" level inputs by altering the "gamma correction" applied to each LED on an independent basis.

Figure 2:
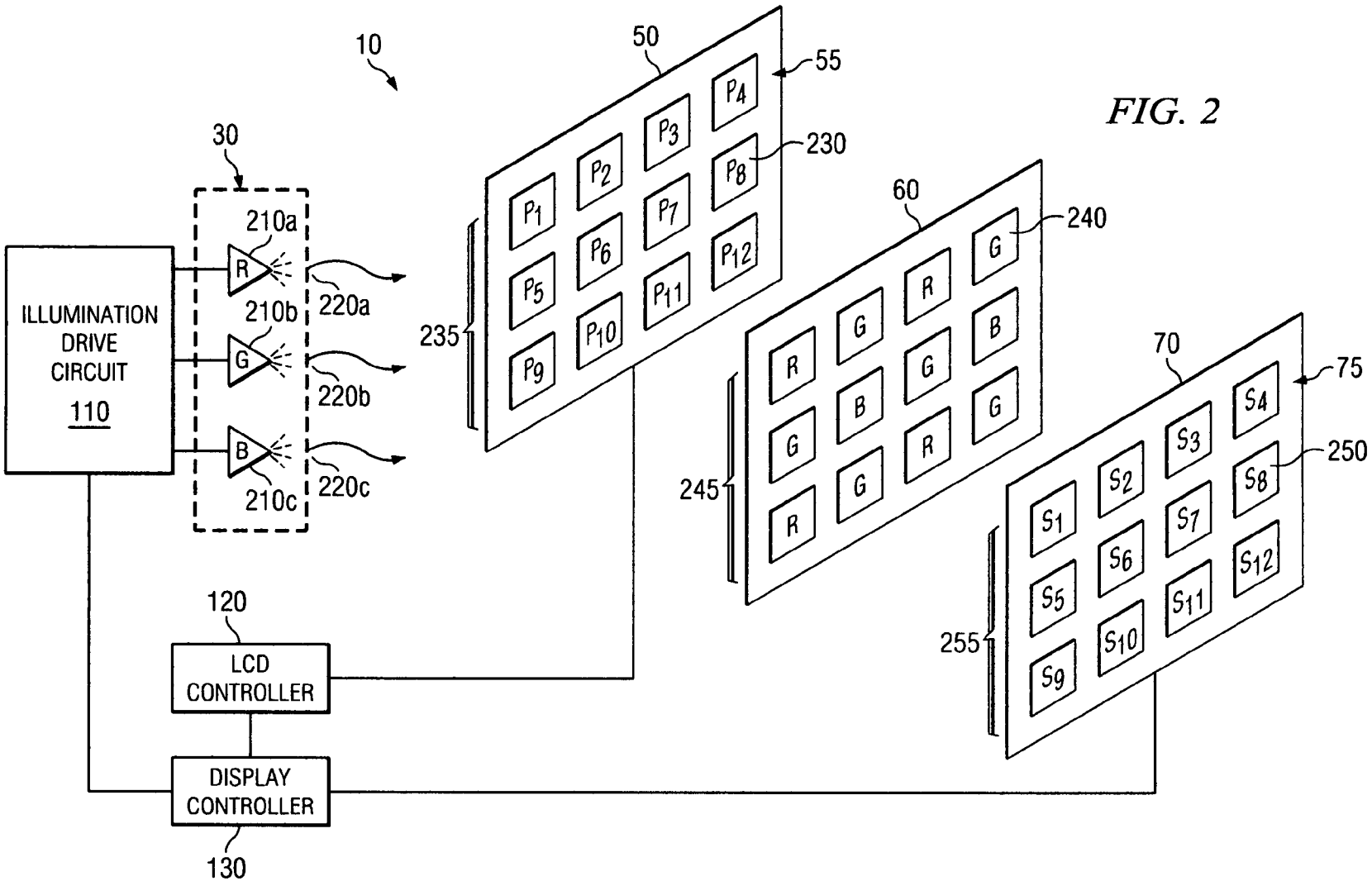
FIG. 2 is a pictorial representation of a portion of the exemplary display device of FIG. 1, in accordance with embodiments of the present invention.

FIG. 2 is a pictorial representation of an exemplary display device 10 capable of providing optical feedback, in accordance with embodiments of the present invention. The display device 10 again includes an illumination device 30 and a liquid crystal device 50. Adjacent the liquid crystal device 50 is a color filter array (CFA) 60 formed of a number of color filters 240. Each color filter 240 is designed to absorb light within a particular wavelength range in order to pass light in other wavelength ranges. For example, a red color filter 240 absorbs green and blue light and passes red light, a blue color filter 240 absorbs red and green light and passes and blue light and a green color filter 240 absorbs red light and passes green and blue light. A common CFA 60 used in display devices 10 is a checkerboard pattern 245 of red, green and blue filters, as shown in FIG. 1.

The illumination device 40 includes light sources 210*a*, 210*b* and 210*c* for emitting light. In FIG. 1, each of the light sources 210*a*, 210*b* and 210*c* is operable to output light in a different wavelength range of the visible light spectrum. For example, in one embodiment, light source 210*a* emits red light 220*a*, light source 210*b* emits green light 220*b* and light source 210*c* emits blue light 220*c*. In an exemplary embodiment, light sources 210*a*, 210*b*and 210*c* are light emitting diodes (LEDs). In other embodiments, light sources 210*a*, 210*b*, 210*c* include any type of device capable of producing light at a particular wavelength range within the visible light spectrum. The light 220*a*, 220*b* and 220*c* output from light sources 210*a*, 210*b* and 210*c* is mixed to produce a uniform field of white light that is optically received by the liquid crystal device 50 via the backlight unit (40, shown in FIG. 1). Each color filter 240 in the CFA 60 filters the light in a particular wavelength range to pass light of a particular color, such as red, green or blue.

The liquid crystal device 50 includes a two-dimensional array of electro-optical elements 230 forming pixels (P1-P12) of an image. The electro-optical elements 230 are spatially arranged in a pattern 235 corresponding to the pattern 245 of color filters 240 in the CFA 60, such that each color filter 240 is optically coupled to receive light from only one electro-optical element 230. The output of the combination of an electro-optical element 230 and associated color filter 240 within the portion 55 is received by a respective corresponding sensor 250 (S1-S12) within an active area 75 of the optical sensor 70.

Thus, each electro-optical element 230/color filter 240 optically couples light of a particular wavelength (e.g., blue, green or red) to only a single sensor 250. For example, in FIG. 2, pixel P1 in the top-left corner of the portion 55 of the liquid crystal device 50 is optically coupled to provide light to the top-left red color filter 240. The top-left red color filter 240 filters the light received from P1 to pass only red light. Sensor S1 on the optical sensor 70 is optically coupled to receive the filtered red light from the top-left red color filter 240. Likewise, sensor S2 is optically coupled to receive green light from the green color filter 240 horizontally-adjacent the top-left red color filter 240, and sensor S6 is optically coupled to receive blue light from the blue color filter 240 diagonally-adjacent the top-left red color filter 240.

As discussed above in connection with FIG. 1, the electro-optical elements 230 within the portion 55 are individually controllable by the LCD controller 120 to selectively transfer the light received from the light sources 210*a*-210*c* to the associated color filters 240. In particular, the LCD controller 120 loads data into each electro-optical element 230 to cause each electro-optical element 230 to either block or transmit the light from the backlight unit.

In an exemplary embodiment, the LCD controller 120 correlates the electro-optical elements 230 with light sources 210*a*, 210*b* and 210*c* according to color. Each electro-optical element 230 is first correlated with the color of the color filter 240 that is optically coupled to that electro-optical element 230. For example, in FIG. 2, P1 in the top-left corner of the array is correlated with the color red, P2 is correlated with the color green and P6 is correlated with the color blue. All of the red electro-optical elements 230 are then correlated with the red light source 210*a*, all of the green electro-optical elements 230 are then correlated with the green light source 210*b* and all of the blue electro-optical elements 230 are then correlated with the blue light source 210*c*.

As a result, in order to provide optical feedback for the red LED 210*a*, the LCD controller 120 loads data that allows only the red electro-optical elements (e.g., elements P1, P3, P9 and P11) to pass light. Thereafter, when the illumination drive circuit 110 activates all of the light sources 210*a*, 210*b* and 210*c*, since only the red electro-optical elements 230 are altered to allow transmission, only red light is passed to the optical sensor 70. For example, in FIG. 2, only sensors S1, S3, S9 and S11 would receive the light. Therefore, only sensors S1, S3, S9 and S11 would produce measurement data. Thus, the measurement data read out to the display controller 130 would represent only the measured intensity of red light emitted from the red LED 210*a* and transmitted through the liquid crystal device 50. In other embodiments, the illumination drive circuit 110 can activate only the light source (e.g., red LED 210*a*) that is being tested for optical feedback.

In another exemplary embodiment, the illumination drive circuit 110 individually activates ("turns on") each of the LEDs 210*a*-210*c* within the illumination device 30 to enable the optical sensor 70 to measure the intensity of light output from the liquid crystal device 50 in response to illumination by one of the LEDs 210*a*-210*c*. For example, to provide optical feedback for the red LED 210*a*, the illumination drive circuit 110 activates the red LED 210*a* to illuminate the electro-optical elements 230 with red light via the backlight unit. The LCD controller 120 loads data into the electro-optical elements that allows all of the electro-optical elements (e.g., elements P1-P12) to pass the red light. However, since the red light is filtered by the green and blue color filters 240 in the CFA 60, only the red color filters associated with electro-optical elements P1, P3, P9 and P11 pass the red light to the optical sensor 70. In other embodiments, the LCD controller 120 can alter only the red electro-optical elements (e.g., P1, P3, P9 and P11) within the portion 55 of the liquid crystal device 50 to allow the red light emitted from the red LED 210*a* to pass through those altered electro-optical elements (e.g., P1, P3, P9 and P11) and into the optical sensor 70.

The measurement data produced by the measurement sensors in the optical sensor 70 is read out by the display controller 130 to provide optical feedback indicating the light intensity degradation of a particular LCD/LED 210*a*-210*c* in the illumination device 30. Continuing with the above example, sensors S1, S3, S9 and S11 in the optical sensor 70 would output measurement data representing the intensity of red light measured at that sensor. The display controller 130 determines an overall measured intensity of the red light at the optical sensor 70 from the measurement data (e.g., an average intensity, maximum intensity, minimum intensity, mean intensity or other measured intensity gleaned from the measurement data), and uses the measured intensity to adjust one or more illumination parameters associated with the red LED 210*a*. For example, in one embodiment, the display controller 130 is operable to compare the measured intensity, as determined from the measurement data, to a known or initial intensity of the red LED 210*a* and estimate a degradation value (e.g., the percentage of combined LED and LCD degradation over time) for the red LED 210*a* based on the comparison between the measured intensity and the known intensity. The display controller 130 uses the estimated degradation value to adjust the duty factor of the pulse width modulation of the red LED 210*a* in the illumination drive circuit 110 to compensate for the perceived degradation of the red LED 210*a*.

Figure 3:
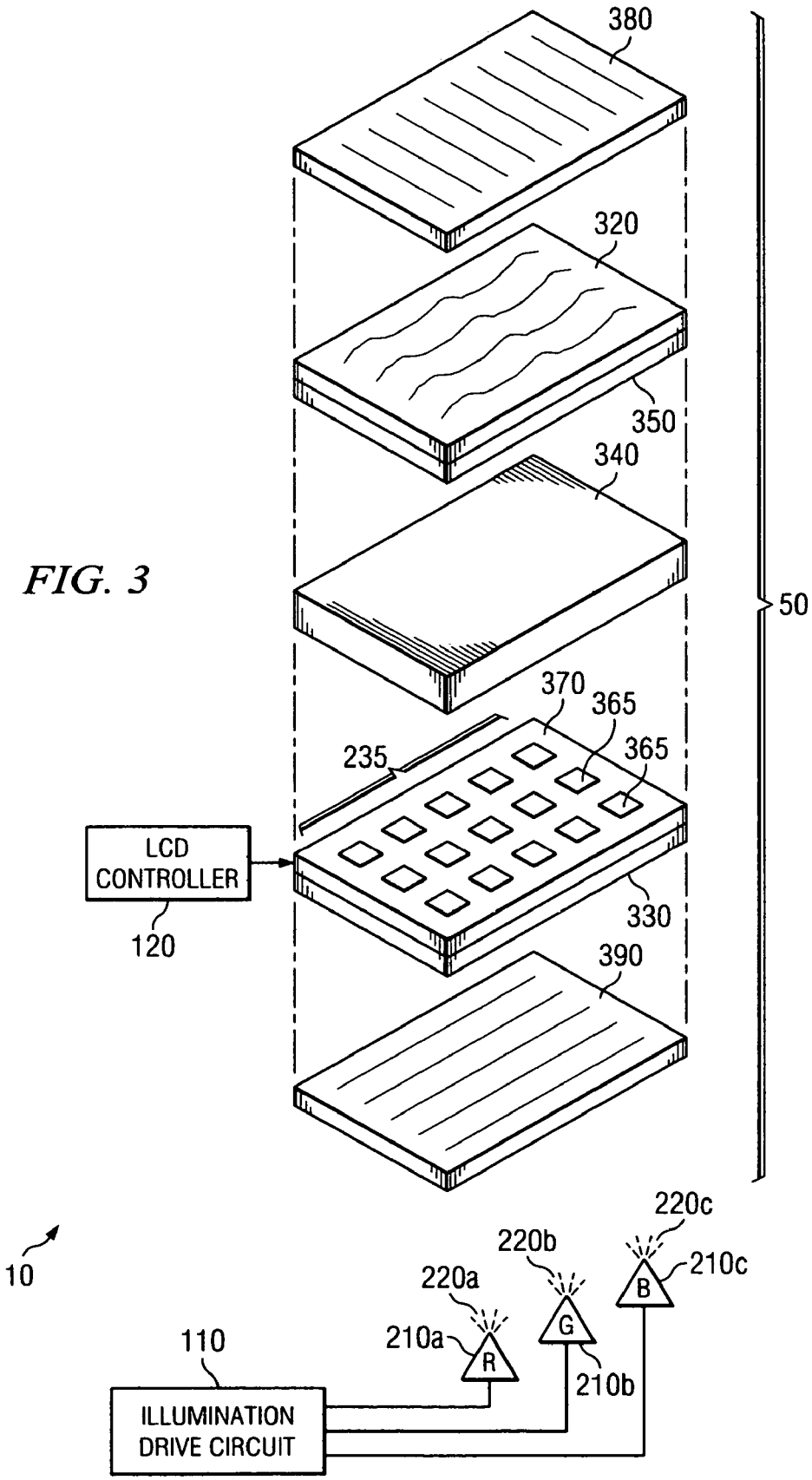
FIG. 3 is an exploded view of an exemplary liquid crystal display device for use in embodiments of the present invention.

FIG. 3 is an exploded view of an exemplary liquid crystal display device 10 for use with embodiments of the present invention. The display device 10 includes the illumination device 30 and the liquid crystal device 60, which includes multiple light sources 210*a*, 210*b*and 210*c*, each operable to output light in a different wavelength range of the visible light spectrum 220*a*, 220*b* and 220*c*, respectively. For example, in one embodiment, light source 210*a* emits red light 220*a*, light source 210*b* emits green light 220*b* and light source 210*c*emits blue light 220*c*. In an exemplary embodiment, the light sources 210*a*-210*c* are individually controllable by the illumination drive circuit 110.

The liquid crystal device 50 includes a substrate 330 on which a two-dimensional array of pixel electrodes 365 are located. The pixel electrodes 365 are spatially arranged in a pattern 235 corresponding to the pattern of color filters, as shown in FIG. 2. Within the substrate 330 below or adjacent to the pixel electrodes 365 is located pixel drive circuitry 370 connected to drive the pixel electrodes 365. For example, in one embodiment, the pixel drive circuitry 370 includes a matrix of thin film transistors (TFTs) for individually addressing each pixel electrode 365. Disposed above the substrate 330 is a transparent glass 320 coated with a layer of transparent electrically conductive material, such as indium tin oxide (ITO). The ITO layer serves as the common electrode 350 of the liquid crystal device 50. Encapsulated between the substrate 330 and the glass 320 is a layer 340 of liquid crystal material that reacts in response to electric fields established between the common electrode 350 and pixel electrodes 365. Adjacent an outer surface of the glass 320 is located a first polarizer 380 and adjacent an outer surface of the substrate 330 is located a second polarizer 390.

The pixel electrodes 365 in combination with pixel drive circuitry 370, common electrode 350, liquid crystal material 340 and polarizers 380 and 390 form the respective individual electro-optical elements (230, shown in FIG. 1) that define the pixels of an image displayed or projected by the display device 10. As described above, each electro-optical element is operable to selectively transfer the light received from the backlight unit. Depending on the voltages applied between the pixel electrodes 365 and common electrode 350, the liquid crystal material 340 reacts at each electro-optical element to either change or not change the polarization state of incoming light. Thus, the common electrode 350 is configured to receive a common electrode signal from the LCD controller 120 for the electro-optical elements and each pixel electrode 365 is configured to receive a respective pixel electrode signal from the LCD controller 120 for altering the liquid crystal material associated with the respective electro-optical element.

In one embodiment, the electro-optical elements allow light of a particular polarization to be transmitted or not transmitted. In another embodiment, the pixel electrodes 365 can be driven with voltages that create a partial reaction of the liquid crystal material 340 so that the electro-optical element is in a non-binary state (i.e., not fully ON or OFF) to produce the "gray scale" transmission. For example, the voltages that create a partial reaction of the liquid crystal material 340 are typically produced by applying signals on the pixel electrode 365 and common electrode 350 that not fully in or out of phase, thereby creating a duty cycle between zero and 100 percent, as understood in the art.

FIG. 4 is a flow chart illustrating an exemplary process 400 for providing optical feedback in displays, in accordance with embodiments of the present invention. Initially, at block 410, a display is provided with electro-optical elements defining pixels of an image, in which each of the electro-optical elements selectively passes light in one of a plurality of different wavelength ranges. For example, in one embodiment, the display includes red, green and blue LEDs for illuminating the electro-optical elements, and each electro-optical element is associated with a red, green or blue color filter for passing red, green or blue light.

Thereafter, to provide optical feedback, at block 420, the electro-optical elements are illuminated with light from one or more LEDs, and at block 430, the electro-optical elements are selectively altered to pass only the light in a particular wavelength range corresponding to one of the LEDs. For example, in one embodiment, all of the LEDs are activated to illuminate the electro-optical elements with white light containing red, blue and green light. To pass only light from a particular LED (e.g., the red LED), only the electro-optical elements having a red color filter are altered so as to pass only red light. In another embodiment, the electro-optical elements are illuminated with light from only a single LED (e.g., the red LED), and at least those electro-optical elements having a red color filter are altered to enable the red light to be passed.

At block 440, the intensity of the light output from the electro-optical elements is measured, and at block 450, the measured intensity is used to adjust an illumination parameter associated therewith. For example, in one embodiment, the measured intensity is compared to a known or initial intensity of a particular LED, and a degradation value (e.g., the percentage of combined LED and LCD degradation over time) is estimated for that LED based on the comparison between the measured intensity and the known intensity. The estimated degradation value is used to adjust the duty factor of the pulse width modulation of the particular LED to compensate for the perceived degradation. At block 460, this process is repeated for each color of LEDs in the display device. Once the feedback is complete, the adjusted illumination parameters are stored for future use at block 470.

The innovative concepts described in the present application can be modified and varied over a wide rage of applications. Accordingly, the scope of patented subject matter should not be limited to any of the specific exemplary teachings discussed, but is instead defined by the following claims.

We claim:

1. A display device, comprising:

light sources, each for emitting light in a different respective wavelength range;

electro-optical elements defining pixels of an image, said electro-optical elements being optically coupled to receive said light emitted from said light sources and spatially arranged such that each of said electro-optical elements is operable to selectively pass said light in said wavelength range of one of said light sources;

a sensor optically coupled to receive light output from a portion of said electro-optical elements and operable to measure a measured intensity of said light output from said portion of said electro-optical elements; and a controller operable to:

activate a selected one of said light sources, alter at least select ones of said electro-optical elements within said portion of said electro-optical elements that are arranged to pass said light in said wavelength range of the selected one of said light sources, read out said measured intensity of light from said sensor; and adjust an illumination parameter associated with said selected one of said light sources based on said measured intensity of light.

2. The display device of claim 1, wherein said light sources are light emitting diodes including a first light emitting diode emitting red light, a second light emitting diode emitting green light and a third light emitting diode emitting blue light.

3. The display device of claim 1, wherein said controller includes an illumination drive circuit operable to individually drive each of said light sources, a pixel controller operable to individually drive each of said electro-optical elements and a display controller operable to control said illumination drive circuit to activate said select one of said light sources and to adjust said illumination parameter, said display controller being further operable to control said pixel controller to alter said select ones of said electro-optical elements.

4. The display device of claim 3, wherein said display controller is further operable to control said sensor to read out said measured intensity of light.

5. The display device of claim 4, wherein said display controller is further operable to compare said measured intensity to a known intensity associated with said select one of said light sources and to estimate a degradation value associated with said select one of said light sources based on the comparison between said measured intensity and said known intensity.

6. The display device of claim 5, wherein said illumination parameter includes a duty factor of the pulse width modulation of said select one of said light sources, and wherein said display controller is further operable to adjust said duty factor to compensate for said degradation value.

7. The display device of claim 1, wherein said controller is operable to activate all of said light sources.

8. The display device of claim 1, further comprising:

an array of color filters, each optically coupled to a respective one of said electro-optical elements, each of said color filters for transmitting light in one of said wavelength ranges to enable said respective electro-optical element to selectively pass said light in said wavelength range of one of said light sources.

9. The display device of claim 1, wherein said sensor includes an active area disposed adjacent a portion of said color filters corresponding to said portion of said electro-optical elements.

10. The display device of claim 1, further comprising:

a backlight unit optically coupled to receive said light from each of said light sources and to provide a uniform field of said light to said electro-optical elements.

11. The display device of claim 1, wherein said electro-optical elements comprise liquid crystal material, and wherein said electro-optical elements further comprise:

a common electrode configured to receive a common electrode signal for said electro-optical elements; and a respective pixel electrode for each of said electro-optical elements, each of said respective pixel electrodes configured to receive a respective pixel electrode signal for altering said liquid crystal material associated with said respective electro-optical element.

12. The display device of claim 1, wherein said controller is further operable to alter said electro-optical elements such that said electro-optical elements are in a non-binary state and to adjust said illumination parameter as a function of a current state of said electro-optical elements.

13. A method for providing optical feedback in a display, said method comprising:

providing electro-optical elements defining pixels of an image, each of said electro-optical elements for selectively passing light in one of a plurality of different wavelength ranges;

illuminating said electro-optical elements with light in at least a select one of said wavelength ranges;

altering at least select ones of said electro-optical elements to pass said light in said select one of said wavelength ranges;

measuring a measured intensity of light output from a selected one of said electro-optical elements; with light of the selected one of said wavelength ranges and adjusting an illumination parameter associated with said selected one of said wavelength ranges based on said measured intensity.

14. The method of claim 13, wherein said illuminating further comprises:

activating at least a select one of a plurality of light sources, each of said light sources for emitting light in one of said wavelength ranges.

15. The method of claim 14, wherein said adjusting further comprises:

comparing said measured intensity to a known intensity associated with said select one of said light sources; and estimating a degradation value associated with said select one of said light sources based on said comparing.

16. The method of claim 15, wherein said adjusting further comprises:

adjusting a duty factor of the pulse width modulation of said select one of said light sources to compensate for said degradation value.

17. The method of claim 12, wherein said providing said electro-optical elements further comprises:

providing an array of color filters, each optically coupled to a respective one of said electro-optical elements, each of said color filters for transmitting light in one of said wavelength ranges to enable said respective electro-optical element to selectively pass said light in said respective wavelength range.

18. The method of claim 17, wherein said measuring said measured intensity further comprises:

providing a sensor disposed adjacent a portion of said color filters to receive said light output from a corresponding portion of said electro-optical elements, said portion including said select ones of said electro-optical elements.

19. The method of claim 12, wherein said electro-optical elements comprise liquid crystal material, and wherein said altering further comprises:

altering said liquid crystal material associated with each of said select ones of said electro-optical elements.

20. The method of claim 12, further comprising:

repeating said illuminating, said altering, said measuring and said adjusting for each of said wavelength ranges.

* * * * *